US005797774A

United States Patent [19]

Kaneko

[11] Patent Number: 5,797,774

[45] Date of Patent: Aug. 25, 1998

[54] CONTACT

[75] Inventor: Tetsuya Kaneko, Chiba-ken, Japan

[73] Assignee: Yamaichi Electronics Co., Ltd., Tokyo, Japan

[21] Appl. No.: 773,036

[22] Filed: Dec. 24, 1996

[30] Foreign Application Priority Data

Dec. 28, 1995 [JP] Japan ..... 7-353191

[51] Int. Cl.[6] ..... H01R 11/22

[52] U.S. Cl. ..... 439/857; 439/342

[58] Field of Search ..... 439/263–269, 439/342, 851, 856, 857, 861

[56] References Cited

U.S. PATENT DOCUMENTS

| | | | |
|---|---|---|---|
| 5,213,530 | 5/1993 | Uratsuji | 439/856 X |
| 5,299,950 | 4/1994 | Kaneko | 439/342 |
| 5,458,513 | 10/1995 | Matsuoka | 439/857 |

FOREIGN PATENT DOCUMENTS 6-75417 9/1994 Japan .

*Primary Examiner*—Khiem Nguyen

*Attorney, Agent, or Firm*—Wenderoth, Lind & Ponack, L.L.P.

[57] ABSTRACT

A contact includes a first contact piece and a second contact piece extending vertically and arranged so that plate surfaces thereof are opposed to each other. A pin terminal projecting vertically from a lower surface of an IC body can be laterally moved and forcibly introduced in between the first contact piece and the second contact piece in order to achieve an electrical connection under pressure. Upper end portions of the first and second contact pieces are bent forwardly to form forwardly-bent pieces, respectively, and an upper edge portion of each of the forwardly-bent pieces is bent backwardly to form a backwardly-bent upper piece. An inner curved-surface of the backwardly-bent piece serves as a pressure contact surface for contacting the pin terminal. A side edge portion of the forwardly-bent piece on the pin terminal introduction side is bent backwardly to form a backwardly-bent side piece continuous with the backwardly-bent upper piece, an inner curved-surface of the backwardly-bent side piece is continuous with the inner curved-surface of the backwardly-bent upper piece, and an inner curved-surface of an upper end of the backwardly-curved side piece serves as a pressure contact surface at an early stage of introduction of the pin terminal.

7 Claims, 4 Drawing Sheets

CONTACT

BACKGROUND OF THE INVENTION

1. Field of the Invention

This invention relates to a contact which is subjected to contact with a pin terminal vertically projecting from a lower surface of an IC body such as a PGA type IC.

2. Brief Description of the Prior Art

Japanese Patent Publication No. 75417/1994 discloses a contact which is subjected to contact under pressure with a pin terminal of the PGA type IC package. This contact comprises a first contact piece and a second contact piece extending in a vertical direction and arranged such that their plate surfaces oppose each other. Upper end portions of the first and second contact pieces are bent forwardly to form forwardly-bent pieces, respectively. Inner edge portions of plate thickness-wise faces (faces formed by blanking) at the upper ends of the forwardly-bent pieces serve as pressure contact portions for contact with the pin terminal.

This conventional contact has the following shortcomings. When the pin terminal is laterally moved in order to be forcibly guided into between the forwardly-bent pieces, there is a fear that the side faces of the pin terminal will be badly damaged (overly wiped) by the sharp edge portions of the contact. This means that it is difficult to utilize such a contact and accommodate increasing tendency forward arranging the pin terminals at very small pitches and making the external size of each terminal very small.

Moreover, when the pin terminal is guided into between the forwardly-bent pieces, a resistance to introduction of pin terminal to the sharp edge portions, particularly an initial resistance of introduction is increased. This causes an overly large bending force against the pin terminal. In addition, the above conventional contact has a vital shortcoming in operating force when the pin terminal is laterally moved (i.e., when the IC is laterally moved).

The present invention has been accomplished in view of the above-mentioned situation.

SUMMARY OF THE INVENTION

It is, therefore, an object of the present invention to provide a contact capable of reducing an initial introduction resistance of a pin terminal.

Another object of the invention is to provide a contact in which a favorable wiping action is available.

To achieve the above objects, there is essentially provided a contact including a first contact piece and a second contact piece extending vertically and having plate surfaces thereof opposed to each other. A pin terminal vertically projecting from a lower surface of an IC body can be laterally moved and forcibly introduced in between the first contact piece and the second contact piece in order to achieve an electrical connection under pressure. Upper end portions of the first and second contact pieces are bent forwardly to form forwardly-bent pieces, respectively. An upper edge portion of each of the forwardly-bent pieces is bent backwardly to form a backwardly-bent upper piece. An inner curved-surface of the backwardly-bent piece serves as a pressure contact surface with the pin terminal. A side edge portion of the forwardly-bent piece on the pin terminal introduction side is bent backwardly to form a backwardly-bent side piece continuous with the backwardly-bent upper piece. An inner curved-surface of the backwardly-bent side piece is continuous with the inner curved-surface of the backwardly-bent upper piece. An inner curved-surface of an upper end of the backwardly-curved side piece serves as a pressure contact surface at an early stage of introduction of the pin terminal.

The above and other objects and features of the present invention will become more readily appreciated and understood from a consideration of the following detailed description of the preferred embodiment when taken together with the accompanying drawings.

DETAILED DESCRIPTION OF THE PREFERRED EMBODIMENT

Figure 1:
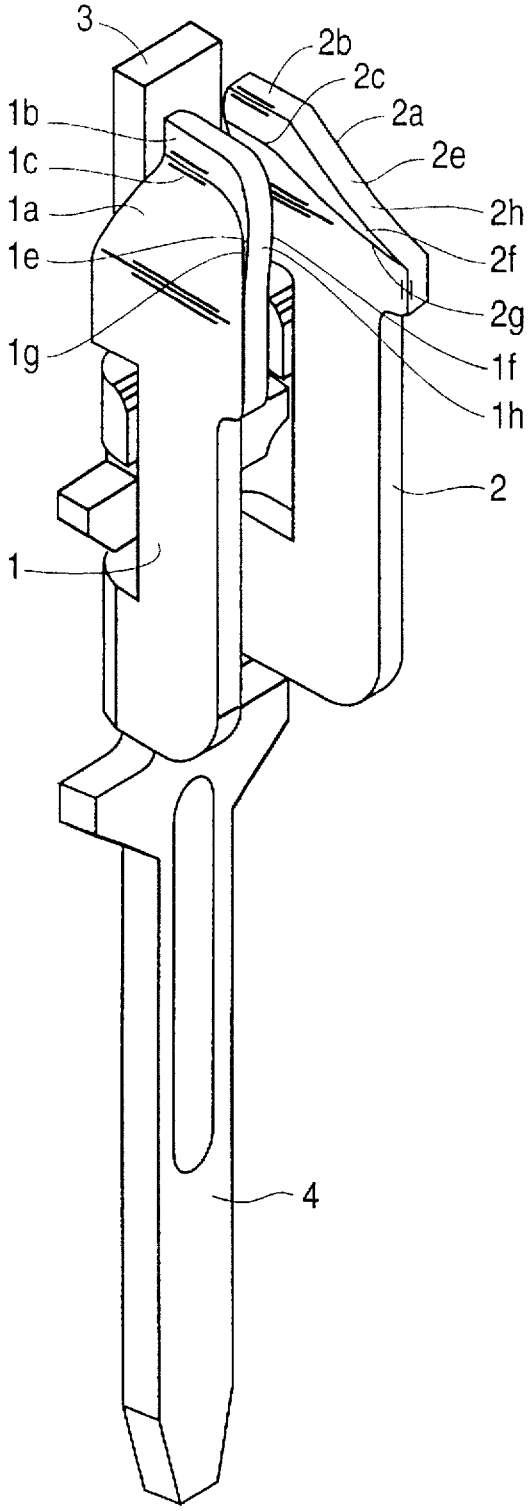
FIG. 1 is a perspective view showing a contact according to one preferred embodiment of the present invention.
Figure 2B:
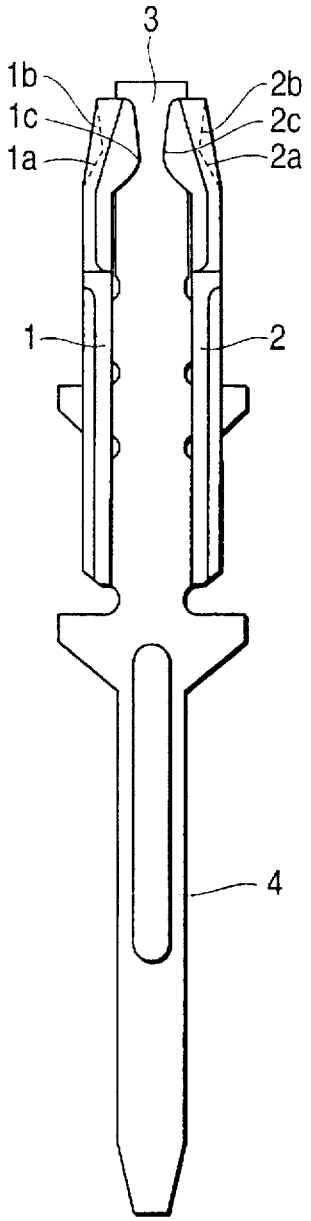
FIG. 2(B) is a front view of the contact.
Figure 2A:
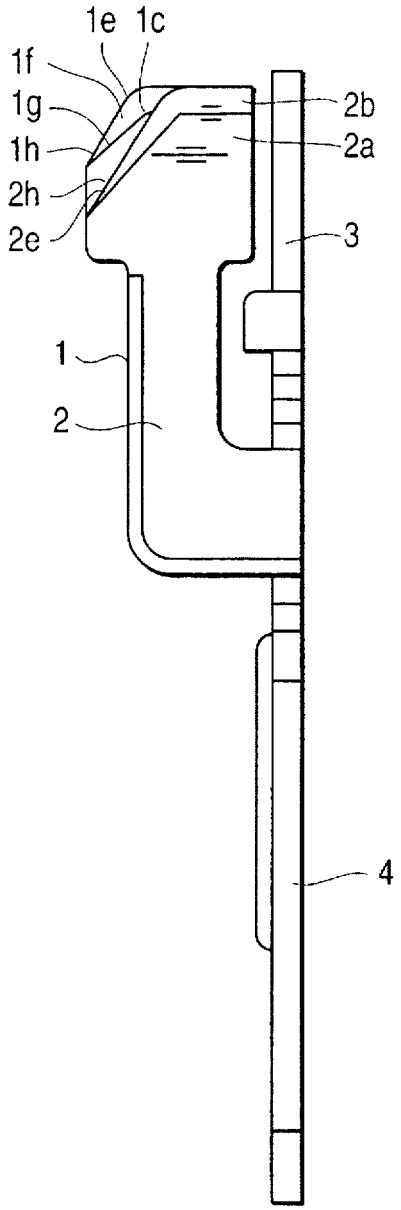
FIG. 2(A) is a side view of the contact.
Figure 2C:
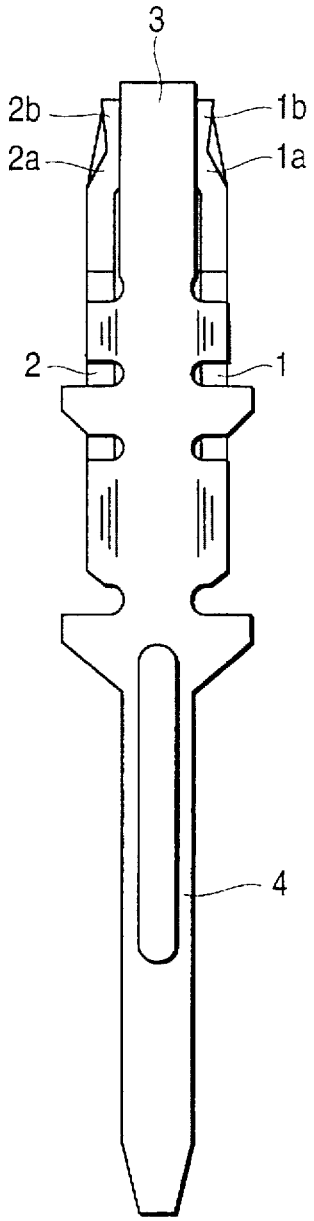
FIG. 2(C) is a rear view of the contact.
Figure 3:
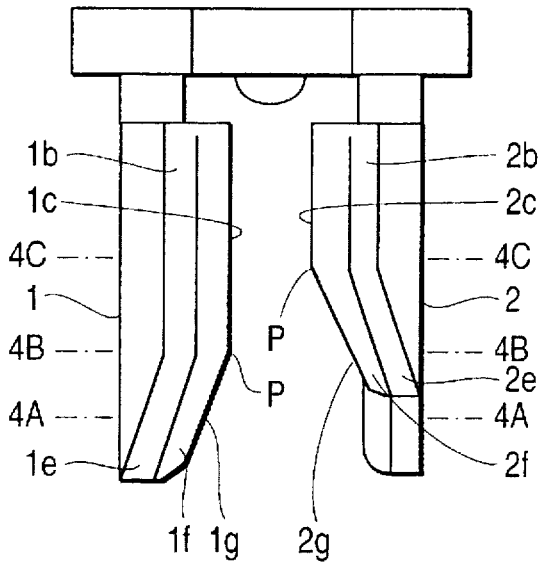
FIG. 3 is an enlarged plan view of the contact.
Figure 4A:
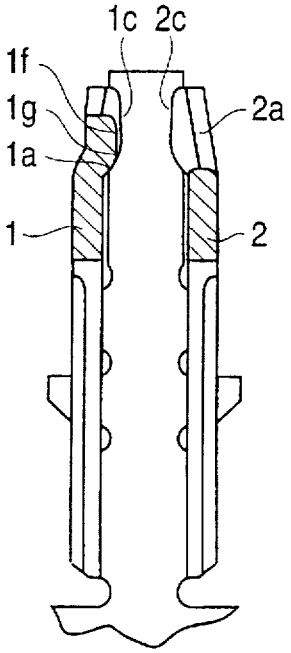
FIG. 4(A) is a sectional view taken on line 4A—4A of FIG. 3.
Figure 4B:
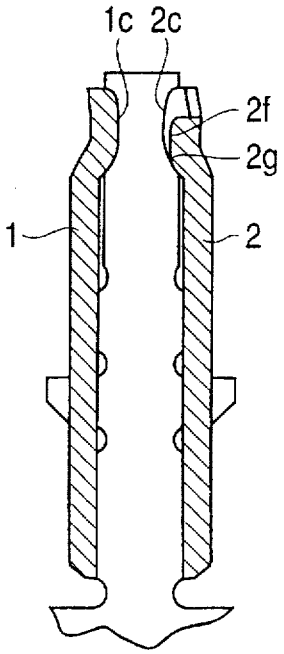
FIG. 4(B) is a sectional view taken on line 4B—4B of FIG. 3.
Figure 4C:
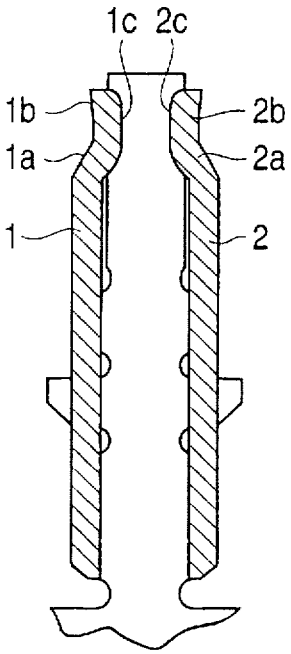
FIG. 4(C) is a sectional view taken on line 4C—4C of FIG. 3.

One preferred embodiment of a contact according to the present invention will now be described with reference to the accompanying drawings.

As shown in FIGS. 1 through 4, a contact of according to one preferred embodiment of the present invention includes a first contact piece 1, a second contact piece 2, and a third contact piece 3.

The first and second contact pieces 1 and 2 extend vertically and are arranged so that their plate surfaces as paralleled and opposed to each other. One side of a space formed between the opposed first and second contact pieces 1 and 2 serves as an introduction port for a pin terminal 5, and the third contact piece 3 is disposed at the other side of the space.

The third contact piece 3 extends vertically as in the case with the first and second contact pieces 1 and 2. One plate surface of the third contact piece 3 faces at generally right angles with respect to the plate surfaces of the first and second contact pieces 1 and 2. Accordingly, the first through third contact pieces 1, 2 and 3 are arranged in a generally U-shaped pattern. The first and second contact pieces 1 and 2 and the third contact piece 3 are connected together at side edge portions of lower ends thereof. A male terminal 4 extends downwardly from a lower edge portion of the third contact piece 3 so as to be subjected to contact with a wiring board, etc. The contact thus constructed forms a contact unit.

The above-mentioned contact is formed by blanking a belt-shaped metal material and bending the same by a required amount. Those surfaces of the belt-like metal material which correspond to the top and back surfaces of the contact are referred to as the "plate surfaces", and those surfaces of the belt-like metal material which are formed by blanking are referred to as the "plate thickness-wise surfaces".

The above-mentioned contact is subjected to contact under pressure with a pin terminal 5 of a PGA type IC package. The IC package has a plurality of such pin terminals 5 extending vertically from a lower surface of the IC body. Each pin terminal 5 is laterally moved and forcibly introduced in between the first and second contact pieces from one side thereof as discussed in the aforementioned Japanese Patent Publication No. 75417/1994.

The first and second contact pieces 1 and 2 have sufficient resiliency for allowing the forcible introduction of the pin terminal 5. The pin terminal 5 is forcibly introduced into the contact while displacing the first and second contact pieces 1 and 2 backwardly against the resiliency of the first and second contact pieces 1 and 2, so as to cause the pin terminal 5 to be contacted under pressure by the reaction force of the first and second contact pieces. The pin terminal 5 is introduced into the contact unit until it is brought into contact with the third contact piece 3 or until it is brought to a location proximate to the third contact piece 3.

The contact according to this preferred embodiment of the present invention is improved in the area in which it is subject to contact under pressure with the pin terminal when the pin terminal is forcibly introduced. This will now be described in detail.

The first and second contact pieces 1 and 2 are forwardly bent at their upper end portions to form forwardly-bent pieces 1*a* and 2*a*, respectively. The bent portions of the forwardly-bent pieces 1*a* and 2*a* extend in a lateral movement direction of the pin terminal 5.

Furthermore, the forwardly-bent pieces 1*a* and 2*a* are bent backwardly at their upper edge portions to form backwardly-bent upper pieces 1*b* and 2*b*, respectively. The bent-portions of the backwardly-bent upper pieces 1*b* and 2*b* also extend in the lateral movement direction of the pin terminal 5. Inner curved-faces 1*c* and 2*c* of the bent-portions are serve as pressure contact surfaces for contacting with the pin terminal 5.

Moreover, side edge portions of the forwardly-bent pieces 1*a* and 2*a* on the pin terminal introduction side and side edge portions of the backwardly-bent upper pieces 1*b* and 2*b* on the pin terminal introduction side are bent backwardly to form backwardly-bent side portions 1*e* and 2*e* which are continuous with the backwardly-bent upper pieces 1*b* and 2*b*. Inner inclination surfaces 1*f* and 2*f* diverging towards the introduction opening side for introduction of the pin terminal serve as guide surfaces for guiding the introduction of the pin terminal, whereas inner curved-surfaces 1*g* and 2*g* of the bent-portions of the backwardly-bent side pieces are continuous with the inner curved-surfaces 1*c* and 2*c* of the backwardly-bent upper pieces 1*b* and 2*b*, so that the inner curved-surfaces 1*g* and 2*g* serve as pressure contact surfaces at an early stage of introduction of the pin terminal 5.

As a concrete example, the plate thickness-wise surfaces of the side edges of the forwardly-bent pieces 1*a* and 2*a* on the pin terminal introduction side serve as inclination surfaces 1*h* and 2*h* which are upwardly slanted towards upper ends of the side edges of the forwardly-bent pieces from lower ends thereof. The backwardly-bent side pieces 1*e* and 2*e* are formed on edge portions of the inclination surfaces 1*h* and 2*h*, respectively. The inclination surfaces 1*h* and 2*h* are arranged to be offset in the introduction direction of the pin terminal. Also, by this, the introduction side end portions of the inner bent-surfaces 1*c* and 2*c* of the backwardly-bent upper pieces 1*b* and 2*b* are arranged to be offset in the introduction direction of the pin terminal.

Owing to the above arrangement, the pin terminal 5 contacts the inner curved-surface 1*g* of the backwardly-bent side piece 1*e* on a front stage first and then contacts the inner curved-surface 2*g* of the backwardly-bent piece 2*e* on a rear stage, thereby reducing the initial introduction resistance of the pin terminal.

Next, the steps for introducing the pin terminal into the contact will be described with reference to FIGS. 5 and 6.

The pin terminal 5 vertically projecting from a lower surface of the IC body is inserted into one side portion of the contact with no load and low resistance. Then, the pin terminal 5 is laterally moved from the inserted position and forcibly introduced in between the first and second contact pieces 1 and 2.

Figure 5A:
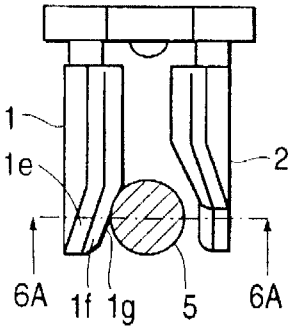
FIGS. 5(A) through 5(D) plan views showing a pin terminal in section for explaining the sequential steps for introducing the pin terminal into the contact.
Figure 5B:
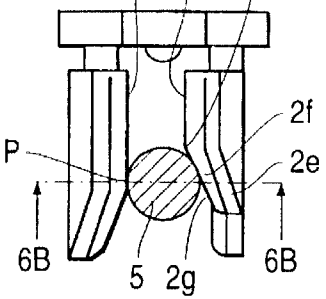
Figure 6A:
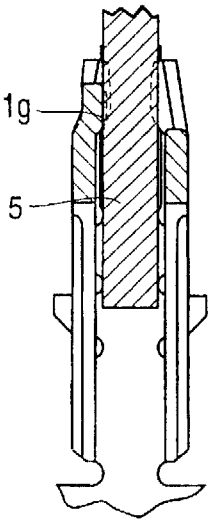
FIG. 6(A) is a sectional view taken on line 6A—6A of FIG. 5(A)
Figure 6B:
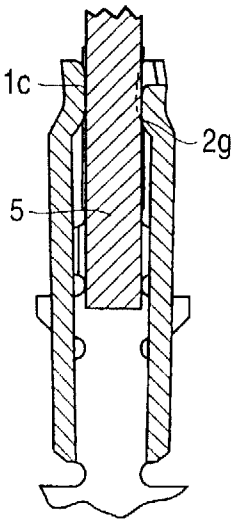
FIG. 6(B) is a sectional view taken on line 6B—6B of FIG. 5(B)

As shown in FIGS. 5(A) and 6(A), the pin terminal 5 being moved laterally gradually starts contacting and sliding on the inner slant surface 1*f* of the backwardly-bent side piece 1*e* of the first contact piece 1 or the inner curved-surface 1*g* serving the inner slant surface If as an escaping surface. Then, as shown in FIGS. 5(B) and 6(B), the pin terminal 5, guided by the surface 1*f* or 1*g* comes to contact with the inner curved-surface 1*c*. Subsequently, from the state of FIGS. 5(A) and 6(A), the pin terminal 5 comes into contact with and slide on the inner slant surface 2*f* of the backwardly-bent sides pieces 2*e* of the second contact piece 2 or the inner curved-surface 2*g* serving the inner slant surface 2*f* as an escaping surface, and then, guide by the surface 2*f* or 2*g* starts contacting the inner curved surface 2*c*.

Figure 5C:
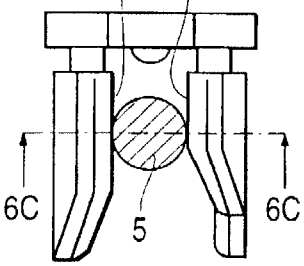
Figure 5D:
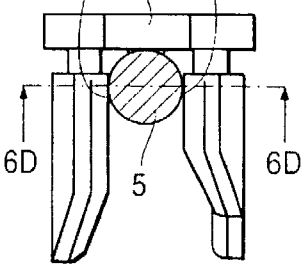
Figure 6C:
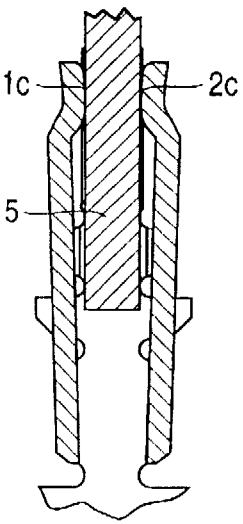
FIG. 6(C) is a sectional view taken on line 6C—6C of FIG. 5(C)
Figure 6D:
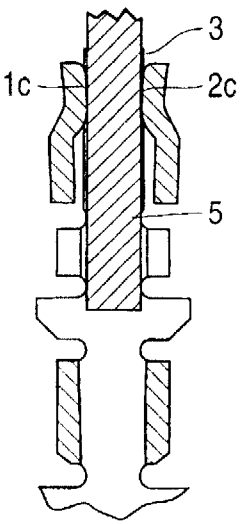
FIG. 6(D) is a sectional view taken on line 6D—6D of FIG. 5(D).

When the pin terminal 5 is further laterally moved, as shown in FIGS. 5(C) and 6(C), the pin terminal 5 is introduced in between and slides on the inner curved-surfaces 1*c* and 2*c*. Then, as shown in FIGS. 5(D) and 6(D), the pin contact 5 comes into contact with the third contact piece 3 at the final ends of the curved-surfaces.

When the pin terminal 5 moves from the inner curved-surfaces 1*g* and 2*g* to the inner curved-surface 1*c* and 2*c*, it passes a curved-surface part at an angular connecting portion P between the inner side surfaces 1*g*, 2*g* and 1*c*, 2*c*, where the pin terminal 5 receives a stronger pressure contacting force.

The third contact piece 3 has not only a function for preventing the pin terminal 5 from escaping from between the first and second contact pieces 1 and 2, but also a function-for supplementing the contact of the first and second contact pieces. It should be noted, however, that the present invention can likewise be applied to a contact construction in which there is no provision of the third contact piece 3.

According to the present invention, by virtue of the features of forming the backwardly-bent side piece continuous with the backwardly-bent upper piece along with the function for guiding the pin terminal with the cooperation of its inner curved-surface and the function for reducing the frictional resistance of introduction, the pin terminal can be forcibly introduced smoothly between the first and second contact pieces with a reduced operating force. Moreover, the inner curved-surface of the backwardly-bent upper piece exhibits a function for reducing a continuous frictional resistance during introduction of the pin terminal.

Furthermore, the inner curved-surface of the backwardly-bent side piece axially slides on the peripheral surface of the pin terminal, thereby providing a favorable wiping action. Also, the curved-surface of the connecting angle portion between the inner curved-surface of the backwardly-bent upper piece and the inner curved-surface of the backwardly-curved side piece generates a comparatively large initial pressure contacting force, thereby providing a favorable wiping action when the pin terminal slides on this curved-surface of the angle portion. Thereafter, the inner curved-surface of the backwardly-bent upper piece also provides an appropriate degree of wiping action.

Thus, according to the present invention, there can be provided a contact capable of reducing an initial resistance during introduction of the pin terminal, providing a favorable wiping action, effectively preventing the surface of the pin terminal from being badly damaged, and also contributing to the solution of the aforementioned problems inherent in the conventional contact.

While one preferred embodiment of a contact according to the present invention has thus far been described with reference to the drawings, it should be borne in mind that such an embodiment is merely illustrative of the gist of the present invention and is accordingly subject to modification and change.

What is claimed is:

1. A contact for contacting with a pin terminal projecting vertically from a lower surface of an IC body, said contact comprising:

first and second contact pieces extending vertically and respectively having plate surfaces opposed to one another so as to receive the pin terminal therebetween under pressure;

wherein upper end portions of said first and second contact pieces are bent forwardly to form forwardly-bent pieces, respectively;

wherein upper edge portions of said forwardly-bent pieces are respectively bent backwardly to form backwardly-bent upper pieces;

wherein inner curved-surfaces of said backwardly-bent upper pieces respectively serve as pressure contact surfaces to contact with the pin terminal;

wherein side edge portions of said forwardly-bent pieces on a pin terminal introduction side thereof are respectively bent backwardly to form backwardly-bent side pieces continuous with said backwardly-bent upper pieces;

wherein inner curved-surfaces of said backwardly-bent side pieces are respectively continuous with said inner curved-surfaces of said backwardly-bent upper pieces; and wherein inner curved surfaces of upper ends of said backwardly-bent side pieces respectively serve as pressure contact surfaces to contact with the pin terminal at an early stage of introduction of the pin terminal in an introduction direction in between said first and second contact pieces.

2. A contact as recited in claim 1, further comprising a third contact piece extending vertically and having a plate surface disposed generally perpendicular to said plate surfaces of said first and second contact pieces.

3. A contact as recited in claim 3, wherein said first, second and third contact pieces are connected together at lower ends thereof, respectively.

4. A contact as recited in claim 3, further comprising a male terminal extending downwardly from a lower edge portion of said third contact piece.

5. A contact as recited in claim 1, wherein said first and second contact pieces are connected together at lower ends thereof, respectively.

6. A contact as recited in claim 1, wherein side edges of said forwardly-bent pieces constitute inclination surfaces, respectively.

7. A contact as recited in claim 6, wherein said inclination surfaces are offset from one another in the introduction direction.

* * * * *